US007438122B2

(12) United States Patent
Hawranek

(10) Patent No.: US 7,438,122 B2
(45) Date of Patent: Oct. 21, 2008

(54) AXIAL HEAT EXCHANGER

(76) Inventor: Jerzy Hawranek, Krukmakaregatan 1 447 35, Vårgårda (SE)

( * ) Notice: Subject to any disclaimer, the term of this patent is extended or adjusted under 35 U.S.C. 154(b) by 213 days.

(21) Appl. No.: 11/141,192

(22) Filed: Jun. 1, 2005

(65) Prior Publication Data

US 2006/0231242 A1 Oct. 19, 2006

(30) Foreign Application Priority Data

Apr. 15, 2005 (SE) ..... 0500864

(51) Int. Cl.
*F28D 7/10* (2006.01)

(52) U.S. Cl. ..... 165/157; 165/183

(58) Field of Classification Search ..... 165/157, 165/183

See application file for complete search history.

(56) References Cited

U.S. PATENT DOCUMENTS 1,838,105 A * 12/1931 Murray et al. ..... 122/462
1,929,540 A * 10/1933 Trane ..... 165/183
2,185,930 A * 1/1940 Crowiey, Jr. et al. ..... 208/146
2,354,175 A * 7/1944 Wilcoxson ..... 422/185
2,513,373 A * 7/1950 Sporn et al. ..... 62/160
2,640,686 A * 6/1953 Brown, Jr. ..... 165/108
2,804,284 A * 8/1957 Otten ..... 165/166
2,965,360 A * 12/1960 Brown, Jr. ..... 165/144
3,224,168 A * 12/1965 Gregory ..... 96/146
3,363,672 A * 1/1968 Ohsol ..... 165/300
3,406,747 A * 10/1968 White ..... 165/74
3,482,626 A 12/1969 Gainsboro et al.
3,817,708 A * 6/1974 Vernon ..... 422/189
4,098,329 A * 7/1978 Culver ..... 165/140
5,107,922 A 4/1992 So
5,251,603 A 10/1993 Watanabe et al.
5,386,871 A * 2/1995 Master et al. ..... 165/10
5,735,342 A 4/1998 Nitta
7,055,583 B2 * 6/2006 Filippi et al. ..... 165/145

FOREIGN PATENT DOCUMENTS

DE 2 111 387 9/1972
JP 2000088478 A * 3/2000
WO WO 03/085344 10/2003

* cited by examiner

*Primary Examiner*—Allen J Flanigan
(74) *Attorney, Agent, or Firm*—Harness, Dickey & Pierce, P.L.C.

(57) ABSTRACT

The present invention offers an improved axial heat exchanger for exchanging heat between a gas medium and a fluid or liquid medium. The axial heat exchanger comprises a longitudinal and substantially axially extended outer channel that is adapted to enclose a flow of a first gas medium. The heat exchanger also comprises a plurality of substantially parallel inner channels that are adapted to enclose a flow of a second liquid medium. The inner channels are arranged inside the outer channel so as to extend substantially axially along the inside of said outer channel for enabling a transfer of heat between said first gas medium and said second liquid medium. The heat transfer is improved to some extent as the number of inner channels increases and it is further improved in that at least one of the inner channels is joined with at least one elongated sheet. The sheet is arranged to extend substantially axially along the inner channel so as to substantially coincide with the direction of flow of the first gas medium through the outer channel.

9 Claims, 7 Drawing Sheets

AXIAL HEAT EXCHANGER

FIELD OF THE INVENTION

The present invention relates to an axial heat exchanger for exchanging heat between two medium, preferably a gas medium and a liquid medium and most preferably air and water. More particularly, the invention relates to a heat exchanger for regulating the air temperature and the air comfort in a defined space, preferably in an indoor space.

BACKGROUND OF THE INVENTION

Introduction

Transfer of heat is a very common operation in connection with natural and human induced activities. Heat transfer mainly depends on three different mechanisms, namely conduction, convection and radiation.

Heat transfer by conduction is essentially characterized by no observable motion of matter. In metallic solids there is motion of unbound electrons and in liquids there is transport of momentum between molecules and in gases there are molecular diffusion (the random motion of molecules). Heat transfer by convection is essentially a macroscopic phenomenon that arises from the mixing of fluid elements, wherein natural convection may be caused by differences in density and forced convection may be caused by mechanical means. Heat transfer by radiation is essentially characterized by the presence of electromagnetic waves. All materials radiate thermal energy. When radiation falls on a second body it will be transmitted reflected or absorbed. Absorbed energy appears as heat in the body.

Transfer of heat in most heat exchangers takes place mainly by conduction and possibly convection as heat passes through one or several layers of material to reach a flow of heat absorbing fluid or gas. However, other transferring mechanisms may be involved to some extent. The layer or layers of material are normally of different thicknesses and with different thermal conductivities. Consequently, knowledge of the overall heat transfer coefficient is essential in the design of a heat exchanger. With known overall heat transfer coefficient the required heat transfer area is calculated by an integrated energy balance across the heat exchanger.

Heat exchangers are available in a number of various designs. The most common types are the tubular heat exchanger, the plate heat exchanger and the scraped surface heat exchanger. The choice of construction material differ depending on application. In the food industry the predominant materials are stainless or acid proof steel or even more exotic materials like titanium, the latter typically for fluids containing chlorides. In other industries heat exchangers made out of mild steel may be sufficient.

Plate heat exchangers are often used on low-viscous applications with moderate demands on operating temperatures and pressures, typically below 150° C. and 25 bars. Gasket material is chosen to withstand the operating temperature at hand and the constituents of the processing fluid. In the food industry plate heat exchangers are typically used for milk and juice pasteurisers operating at temperatures below 100° C. and pressures below 15 bars.

Tubular heat exchangers are typically used in applications where the demands on high temperatures and pressures are significant. Also, tubular heat exchangers are employed when the fluid contains particles that would block the channels of a plate heat exchanger. In the food industry tubular heat exchangers are typically used for milk and juice sterilisers operating at temperatures up to 150° C. Tubular heat exchangers are also used for moderate to high-viscous and particulate products, e.g. tomato salsa sauce, tomato paste and rice puddings. In some of these cases the operating pressure can exceed 100 bars. Particles up to 10-15 mm in size can be treated in tubular heat exchangers without problems.

Scraped surface heat exchangers are used in applications where the viscosity is very high, where big lumps are part of the fluid or where fouling problems are severe. In the food industry scraped surface heat exchangers are used e.g. on products like strawberry jam with whole strawberries present. The treatment in the heat exchanger is so gentle and the pressure drop so low that the berries will pass the system with only very little damage. The scraped surface heat exchangers is, however, the most expensive solution and is therefore used only when plate heat exchangers and tubular heat exchangers would not perform adequately.

Related Art

U.S. Pat. No. 5,251,603 (Watanabe et al.) discloses a fuel cooling system for a motor vehicle having; a fuel tank (2) for supplying fuel to a motor vehicle engine (E), a refrigerant evaporator (12), a compressor (8) of a refrigeration system for air conditioning and a heat exchanger (15) provided between a fuel pipe (3*b*) and an evaporated refrigerant pipe (13), see e.g. col. 2 lines 45-66 and FIG. 1. The heat exchanger (15) is made up of coaxial inner and outer tubes (17, 18) and, for example, helical heat transfer fins contained in a space between the inner and outer tubes (17, 18), see e.g. col. 3 lines 4-64 and FIG. 2-4. With this construction, the fuel flowing through a fuel return pipe (3*b*) extending between the engine (E) and the fuel tank (2) is caused to flow through the space between the inner and outer tubes (17, 18), whereas evaporated low temperature refrigerant is caused to flow through the inside of the inner tube (17) of the heat exchanger. The inner tube has secured therein, heat exchange fins, for example, of the type extending longitudinally thereof and having wavy transverse cross section. The fuel and the refrigerant exchange heat through the inner tube, whereby the fuel is cooled effectively.

U.S. Pat. No. 5,107,922 (So) discloses an offset strip fin (42) for use in compact automotive heat exchangers (30). The offset strip fin (42) has multiple transverse rows of corrugations extending in the axial direction, wherein the corrugations in adjacent rows overlap so that the oil boundary layer is continually re-started. The fin dimensions have been optimized in order to achieve superior ratio of heat transfer to pressure drop along the axial direction. In one aspect, a compact concentric tube heat exchanger (30) has an off-set strip fin (42) located in an annular fluid flow passageway located between a pair of concentric tubes (32, 34), see e.g. col. 5 line 44 to col. 7 line 6 and FIG. 1-4.

The heat exchangers disclosed in the above Watanabe and So are basically tubular heat exchangers. The exchangers in Watanabe and So are comparably small to fit in a limited inner space of a motor vehicle. The available heat transfer area is therefore limited, which demands a high temperature difference between two heat exchanging media to obtain a sufficient heat exchange. This is confirmed in Watanabe by the use of a compressor (8) for evaporating the refrigerant medium, which leads to a significant cooling of the refrigerant that flows through the inside of the inner tube (17).

WO 03/085344 (Jensen et al.) discloses a heat exchanger assembly comprising an inner tube (3) forming a first channel (24) for a first fluid and an outer tube (1) completely surrounding the inner tube (3) and extending in parallel with respect to the inner tube, which thereby defines a second channel (25)

for a second fluid. Fins (2) are extending between the outside wall of the inner tube (3) and the inside wall of the outer tube (1). The fins (2) are integrated with the inner tube (3) only, see e.g. the abstract on page 1 and FIG. 1-2 in Jensen.

The heat exchanger in Jensen is basically a tubular heat exchanger. The heat transfer occurs through the wall and fins (2) of the inner tube (3). However, looking at the cross-section of the exchanger in FIG. 1-2 it can be seen that the wall and fins (2) of the inner tube (3) are comparable thick. The material in the wall and fins should therefore have a high thermal conductivity to provide a sufficient heat exchange. The thick fins (2) of the inner tube (3) will furthermore reduce the area that is available in the tube (3) for a heat transfer through the wall and fins of the inner tube (3). Typically, a reduced heat transfer area demands an increased temperature difference between the fluids to maintain a sufficient heat exchange. An alternative is to increase the pressure and/or flow of one medium or both media. This is especially so if a heat exchanger as the one in Jensen is used for a heat exchange between a gas medium and a fluid medium, or between two gas media. A gas medium has a lower density than a fluid medium and a gas medium is therefore typically not able to carry, receive or emit the same amount of energy per cubic unit as a fluid medium. This means that a heat transfer to or from a gas medium typically requires a larger heat transfer area compared to the area needed for transferring the same amount of energy to or from a fluid medium within the same time.

U.S. Pat. No. 5,735,342 (Nitta) discloses a heat exchanger system including an outer duct housing (20) and a powered fan (24) at one end. A heat exchanger including two nested pipes (28, 30) is positioned in line with the fan (24) within the duct (20). Each pipe (28, 30) includes radially outward fins (38, 46) and radially inward fins (40, 48). The radially inward fins (40) on the outer pipe (28) and the radially outward fins (46) on the inner pipe (30) are interleaved. End caps (32, 34) placed on the ends of the pipes include baffles (54, 56, 58, 68, 70), which appropriately divide annular manifolds (60, 62) defined between the pipes (28, 30) and between the ends of the fins (38, 40, 46, 48) and the end caps (32, 34) in order that four passes are possible through the length of the heat exchanger.

The inner pipe (30) defines an inner passage through the centre of the pipe (30). The radially inward fins (48) extend into that passage. The two end caps (32, 34) have holes (72, 74), which aligns with the passing trough the inner pipe (30). In this way, the fan (24) can force air through the interior of the heat exchanger as well as outwardly around the heat exchanger with flow in the longitudinal direction of the device, see col. 2 lines 58-65.

The heat exchanger in Nitta is similar to the heat exchanger in Jensen. However, the wall and the fins of the pipes in Nitta seem comparably thinner than their counterpart in Jensen. The demand for a high thermal conductivity in the material of the wall and fins may therefore be lower in Nitta. However, a substantial part of the cross-section in Nitta, as well as in Jensen, is occupied by the wall and fins of the inner pipe. This narrows the passage for the gas or the fluid or similar medium that is supposed to pass through the heat exchanger and the pressure of the medium may therefore have to be increased.

The prior art heat exchangers as described above display one or several of the following drawbacks; small heat exchanging area, high temperature differences, small cross-section for the flow of medium, high medium flow rate, high medium pressure.

The prior art heat exchangers are clearly unsuitable for exchanging heat between a slowly flowing gas medium and a flow of a fluid or liquid medium having a low temperature difference, and they are particularly unsuitable as heat exchangers for regulating the temperature of air slowly flowing through the exchanger for the purpose of regulating the temperature and air comfort in a defined space, preferably in an in door space.

SUMMARY OF THE INVENTION

The present invention offers an improved axial heat exchanger for exchanging heat between a gas medium and a fluid or liquid medium.

The axial heat exchanger according to the present invention comprises a longitudinal and substantially axially extended outer channel—e.g. a tube or similar—that is adapted to enclose a flow of a first gas medium (preferably air). The heat exchanger also comprises a plurality of substantially parallel inner channels—e.g. a pipe or a conduit or similar—that are adapted to enclose a flow of a second liquid medium (preferably water). The inner channels are arranged inside the outer channel so as to extend substantially axially along the inside of said outer channel for enabling a transfer of heat between said first gas medium and said second liquid medium. The heat transfer can be improved by increasing the number of inner channels and it is particularly improved in that at least one of the inner channels and preferably at least two of the inner channels are joined with at least one elongated sheet. The elongated sheet is arranged to extend substantially axially along the inner channel so as to substantially coincide with the direction of flow of the first gas medium through the outer channel.

A plurality of axial heat exchangers according to the present invention can be serially coupled so as to enable a flow of a first gas medium through the outer channel of a first heat exchanger into the outer channel of the next heat exchanger, and so on through each serially coupled heat exchanger. Each serially coupled heat exchanger is provided with a first distribution arrangement and a second distribution arrangement, which arrangements are adapted to be coupled to a supply channel arrangement that extends substantially along the serially coupled heat exchangers for providing a flow of a second liquid medium through the inner channels of each axial heat exchanger.

A plurality of heat exchangers according to the present invention can be coupled in parallel to enable a substantially simultaneous and parallel flow of a first gas medium through the outer channel of each parallel heat exchanger. Each parallel coupled heat exchanger is provided with a first distribution arrangement and a second distribution arrangement, which arrangements are adapted to be coupled to a supply channel arrangement that extends substantially along the parallel coupled heat exchangers for providing a flow of a second liquid medium through the inner channels of each axial heat exchanger.

DETAILED DESCRIPTION OF PREFERRED EMBODIMENTS

A First Embodiment

Figure 1:
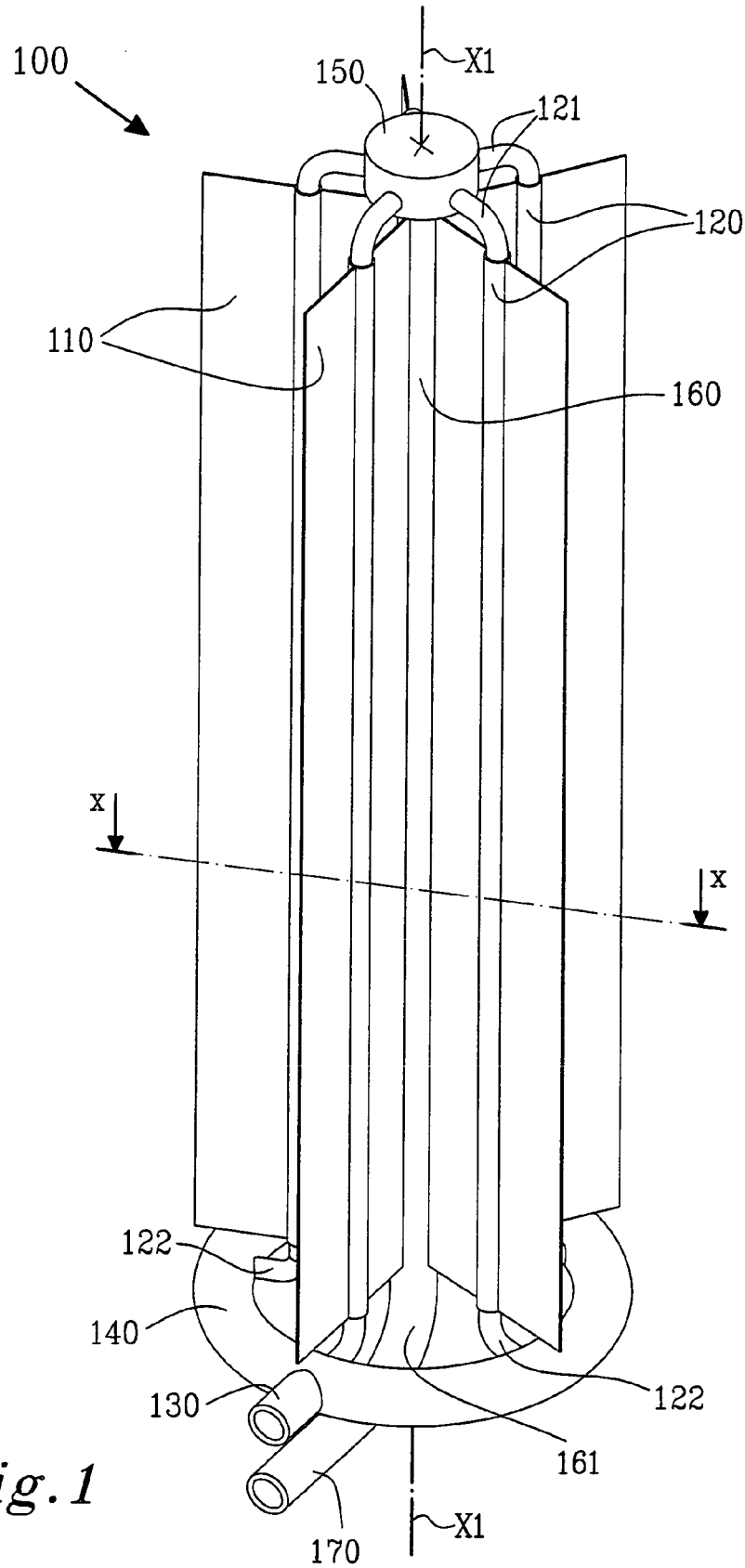
FIG. 1 is a perspective view of an inner heat exchanging structure 100 according to a first embodiment of the present invention.
Figure 2:
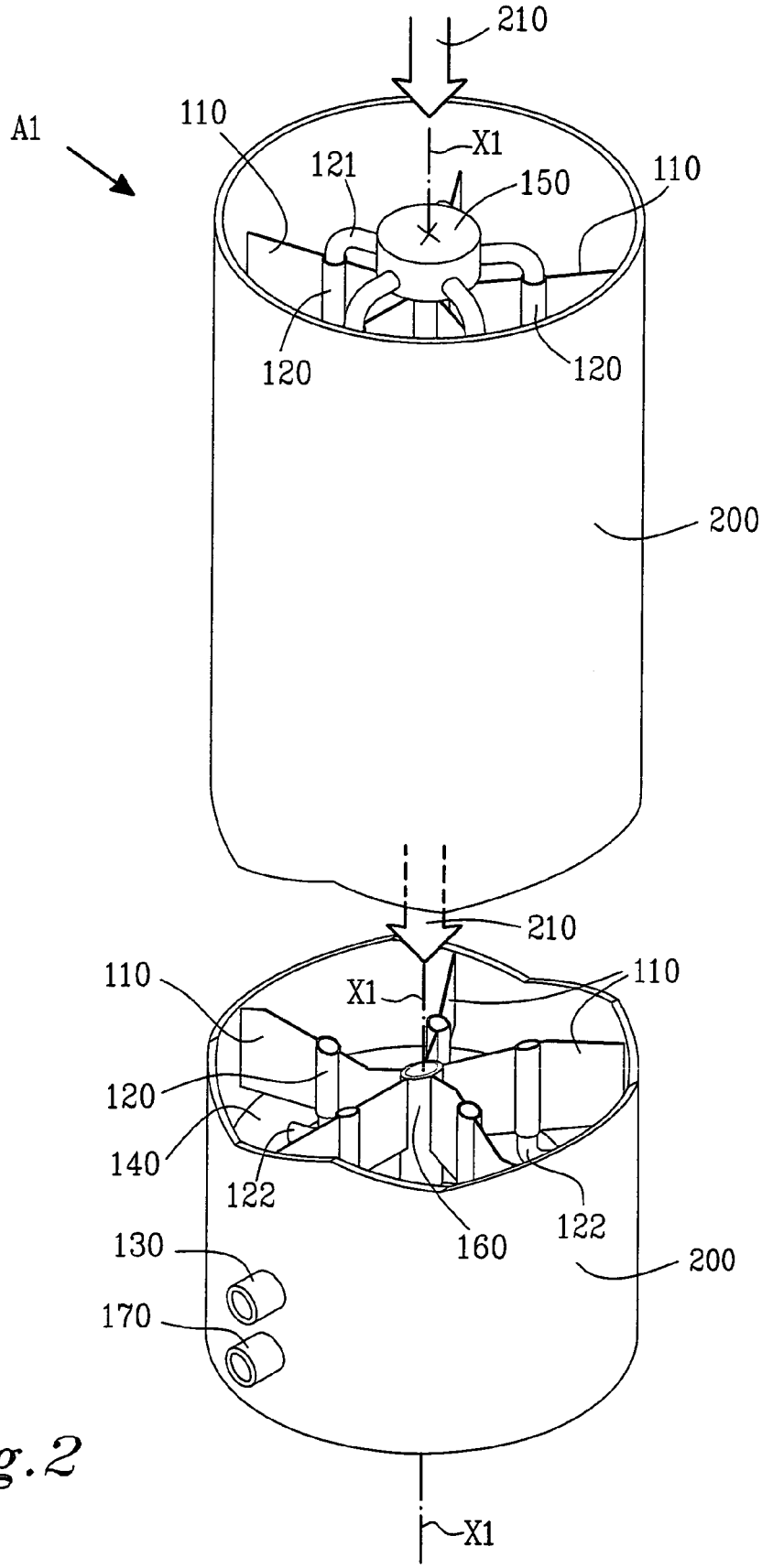
FIG. 2 is a perspective view of the cross-section of the inner heat exchanging structure 100 in FIG. 1 substantially cut along the line X-X.

FIG. 1 is a perspective view showing an inner heat exchanging structure 100 according to a first embodiment of the present invention. The inner heat exchanging structure 100 in FIG. 1 is also shown in FIG. 2, substantially cut along the line X-X in FIG. 1 to uncover a perspective view of the cross-section of the inner heat exchanging structure 100. The inner heat exchanging structure 100 is shown in FIG. 2 arranged inside an outer channel structure 200. The outer channel structure 200 and the enclosed inner heat exchanging structure 100 in FIG. 2 form an axial heat exchanger A1 according to a first embodiment of the present invention.

The exemplifying outer channel structure 200 shown in FIG. 2 has a cylindrical or tubular shape. The inner diameter of the exemplifying outer channel 200 may be approximately 100-500 millimeters, more preferably approximately 100-300 millimeters and most preferably approximately 100-200 millimeters. The wall of the outer channel 200 may have a thickness of a few millimeters, preferably less than two millimeters. Other wall thicknesses and other diameters are clearly conceivable. The length of the exemplifying outer channel 200 may be approximately 400-3000 millimeters, more preferably approximately 500-2000 millimeters and most preferably 600-1500 millimeters, though other lengths are clearly conceivable. The shape and cross-section of the outer channel structure 200 may evidently differ, as long as it encloses the inner heat exchanging structure 100 in a way that enables a first medium to flow along the axial heat exchanger A1 in at least one medium channel and more preferably in several medium channels 210 that are formed between the inner heat exchanging structure 100 and the wall of the outer channel structure 200. The outer channel structure 200 is preferably adapted to contain a flow of a gas medium, preferably air or a similar gas. The medium channels 210 are also indicated in the schematic cross-section of the axial heat exchanger A1 shown in FIG. 6*a*. It can be observed that the medium (e.g. air) may flow in one or the other of the two possible directions in the channels 210.

The wall of the outer channel structure 200 in FIG. 2 is preferably made of a light weight material, e.g. a light metal as aluminum or a plastic material, a carbon fiber material or similar. It is also preferred that the wall of the outer channel structure 200 is comparably thin. A canvas, a cloth, a foil, a film or any similar suitable thin sheet material may therefore form the outer channel structure 200. The sheet material may e.g. be made of metal, rubber, plastic or a fabric or similar. Consequently, a preferred embodiment of the outer channel structure 200 may e.g. have a wall that is made of a plastic cloth, a plastic foil or some similar substantially medium-tight (e.g. air-tight) cloth material or similar having a small weight. The sheet material is preferably wrapped or otherwise arranged around the outside edges of the inner heat exchanging structure 100 so as to form an outer channel structure 200 that encloses the inner heat exchanging structure 100. The sheet material may e.g. be a shrink wrap or even a shrinking tubing that is heated to shrink and fit on the outside of the inner heat exchanging structure 100.

The enclosing outer channel 200 has now been discussed in some detail and the attention is again directed to the inner heat exchanging structure 100 of the heat exchanger A1 shown in FIG. 2. It is clear from FIG. 2 that the heat exchanging structure 100 comprises five fins 110 shaped as thin rectangular sheets. At least four of these fins 110 are clearly shown in FIG. 1. The sheet or fin 110 may have a thickness of some tenths of a millimeter to a few millimeters, preferably less than two millimeters.

The sheets or fins 110 in FIG. 1-2 extend in a first axial direction that is substantially parallel to the axial extension and/or the centre axis X1 of the inner heat exchanging structure 100 in FIG. 1 and the outer channel 200 in FIG. 2. The fins 110 extend substantially along the whole length of the inner heat exchanging structure 100. As can be seen in FIG. 2, the fins 110 of the heat exchanging structure 100 arranged in the axial heat exchanger A1 are extending in the axial extension of the outer channel structure 200, so as to substantially coincide with the direction of flow of a medium that flows within the enclosing outer channel structure 200.

The sheets or fins 110 in FIG. 1-2 extend in a second radial direction, in addition to extending in an axial direction as previously explained. The radial direction extends substantially outwards from the centre or centre axis of the heat exchanging structure 100 towards the outer channel structure 200, which makes the fins 110 look like spokes around a hub. A fin 110 may leave a small gap to the channel structure 200 or it may simply abut the channel structure 200. A fin may also be more tightly connected to the outer channel structure 200, e.g. to form a substantially closed or sealed connection with the outer channel 200.

Even though the exemplifying fin 110 in the heat exchanging structure 100 in FIG. 2 is a straight rectangular sheet arranged in parallel with the extension of the outer channel 200, certain embodiments of the present invention may have sheets or similar that are curved or twisted. For example, sheets that extend in a spiral pattern or similar along the inside of the outer channel structure 200 or similar, or sheets that form one or several medium channels—comparable to the medium channels 210 in FIGS. 2 and 6*a* —which channels e.g. extend in a spiral shaped structure along the inside of an axial outer channel 200 or similar.

The fins 110 in FIGS. 1-2 are made of a heat conductive material, preferably a metal and more preferably a light-weight metal as aluminum or similar. Each fin 110 is joined with an inner small, straight and preferably tubular channel 120 that is positioned in the middle or near the middle of the fin 110. The wall of the exemplifying inner channel 120 may have a thickness of a few tenths of a millimeter to a few millimeters, preferably less than one millimeter, whereas the inner diameter of the inner channel 120 may be approximately 4-20 millimeters, preferably approximately 5-15 millimeters and most preferably approximately 6-10 millimeters. Other wall thicknesses and other diameters are clearly conceivable. The inner channel 120 is preferably made of the same heat conductive material as the fin 110 or a similar material that enables a good transport of heat between the inner channel 120 and the fin 110. The straight inner channel 120 extends along the entire rectangular fin 110 from one short end to the other. The inner channel 120 is preferably adapted to contain a flow of a fluid or liquid medium, preferably water.

It should be added that the present invention is not limited to the channels 120 in FIGS. 1-2. On the contrary, a channel may have a cross-section that is circular or oval as well as partly circular and/or partly oval, or that is triangular, quadratic, rectangular or otherwise polygonal, or a cross-section that is a combination of these examples. Moreover, a fin 110 may be joined with a channel in other positions and/or according to other patterns. For example a channel may be joined with a fin 110 so as to extend along the fin 110 in an s-shaped pattern from one short end to the other. A sheet or a fin 110 or similar may also be provided with two or more channels without departing from the scope of the invention.

The perspective view in FIG. 1 shows that the heat exchanging structure 100 is provided with a lower distribution manifold 130 extending radially out of the heat exchanging structure 100. The lower distribution manifold 130 is connected to a lower distribution channel 140 that in turn is connected to the lower end of each channel 120 in the fins 110 by means of curved lower tubular connecting channels 122 arranged at the lower end of the heat exchanging structure 100. The upper end of each channel 120 in the fins 110 is in turn connected to an upper distribution hub 150 by means of an curved upper tubular connecting channel 121 arranged at the upper end of the heat exchanging structure 100. The upper collecting hub 150 is in turn connected to a center channel 160 that extends axially downwards from the collecting hub 150 substantially coinciding with the centre axis of the heat exchanging structure 100. The wall of the exemplifying center channel 160 may have a thickness of a few tenths of a millimeter to a few millimeters, preferably less than two millimeters, whereas the inner diameter of the center channel 160 may be approximately 20-100 millimeters, preferably approximately 25-75 millimeters and most preferably approximately 25-50 millimeters. Other wall thicknesses and other diameters are clearly conceivable. The lower end of the center channel 160 has a curved section 161 that terminates the center channel 160 in a center-channel manifold 170, which extends radially out of the heat exchanging structure 100 at the lower end, preferably below the fins 110 and preferably below the lower distribution manifold 130.

Such properties as the diameter and wall thickness of the outer channel 200, the diameter and wall thickness of the inner channels 120, the shape and thickness of the fins 110, the choice of material for the outer channel 200, the inner channels 110 and the fins 110 can easily be adapted in a well known manner by a person skilled in the art, so as to fit the application in question, e.g. depending on the temperature, the density, the viscosity, the pressure, the flow rate etc. of the medium that is supposed to flow through the outer channel 200 and the medium that is supposed to flow through inner channels 110.

A Second Embodiment

Figure 3:
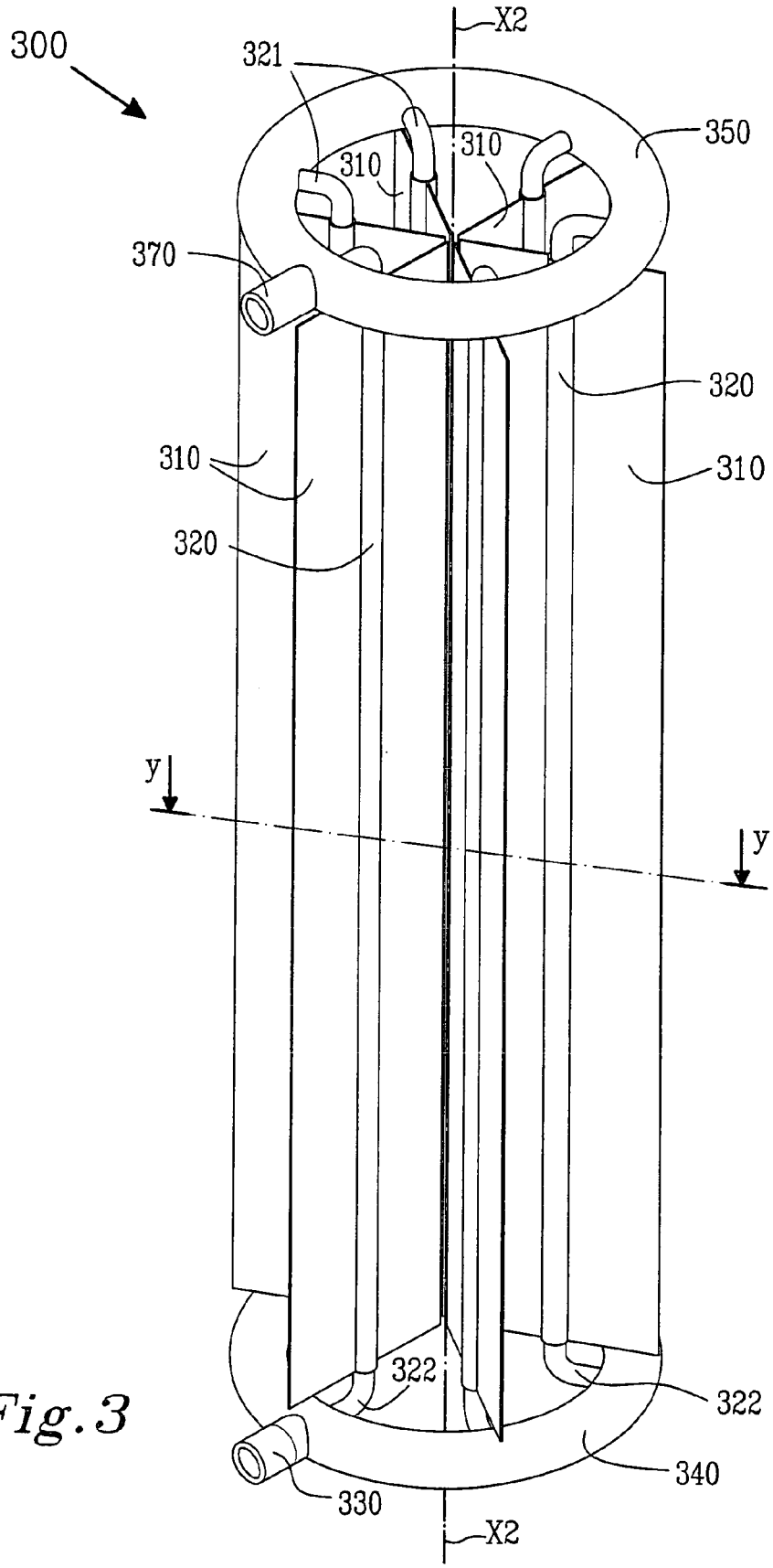
FIG. 3 is a perspective view of an inner heat exchanging structure 300 according to a second embodiment of the present invention.
Figure 4:
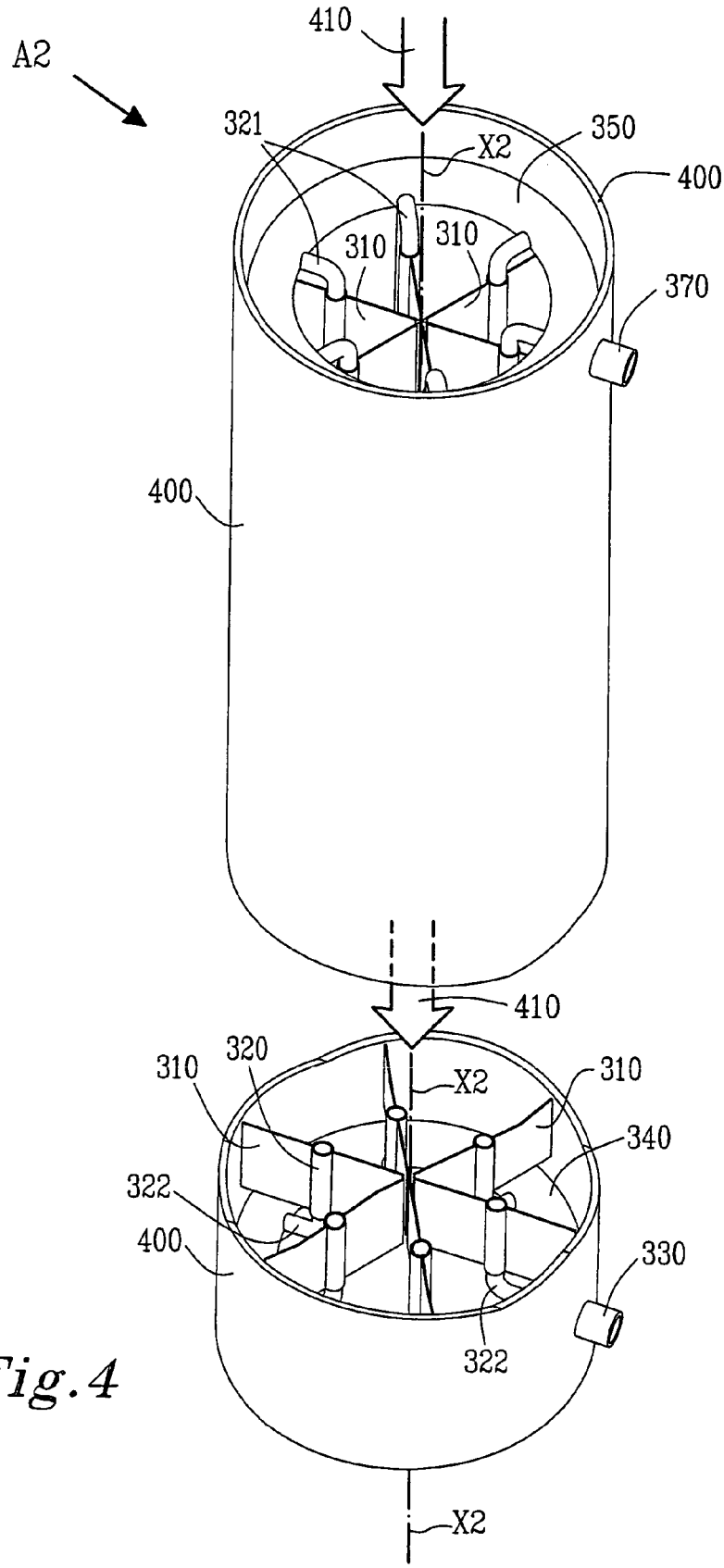
FIG. 4 is a perspective view of the cross-section of the inner heat exchanging structure 300 in FIG. 2 substantially cut along the line Y-Y.

FIG. 3 is a perspective view showing an inner heat exchanging structure 300 according to a second embodiment of the present invention. The inner heat exchanging structure 300 in FIG. 3 is also shown in FIG. 4, substantially cut along the line Y-Y in FIG. 3 to uncover a perspective view of the cross-section of the inner heat exchanging structure 300. The inner heat exchanging structure 300 in FIG. 4 is shown arranged inside an outer channel structure 400. The outer channel structure 400 and the enclosed inner heat exchanging structure 300 in FIG. 4 form an axial heat exchanger A2 according to a second embodiment of the present invention.

The exemplifying channel structure 400 shown in FIG. 4 is similar to the channel structure 200 in the first embodiment shown FIG. 2, especially in that it encloses the inner heat exchanging structure 300 so that a first medium can flow along the axial heat exchanger A2 in at least one medium channel and more preferably in several medium channels 410 that are formed between the inner heat exchanging structure 300 and the wall of the outer channel structure 400. The properties of the outer channel structure 200 as discussed above are therefore applicable mutatis mutandis to the outer channel structure 400. The medium channels 410 are also indicated in the schematic cross-section of the axial heat exchanger A2 shown in FIG. 6*b*.

Furthermore, the fins 310 of the heat exchanging structure 300 shown in FIGS. 3-4 are likewise similar to the fins 110 in the first embodiment shown FIG. 1-2. The properties of the fins 110 as discussed above are therefore applicable mutatis mutandis to the fins 310 in FIGS. 3-4.

For example, the sheets or fins 310 in FIG. 3-4 extend in a first axial direction that is substantially parallel to the axial extension and/or the centre axis X2 of the inner heat exchanging structure 200 in FIG. 3 and the outer channel 400 in FIG. 4. Moreover, each fin 310 in FIGS. 3-4 is joined with an inner small, straight and preferably tubular channel 320 in the same way as the tubular channel 110 in FIGS. 1-2. However, it may be noted that the heat exchanging structure 300 of the heat exchanger A2 comprises six fins 310, compared to the five fins 110 in the heat exchanging structure 100 of the heat exchanger A1. This illustrates that the number of fins or sheets or similar can vary in a heat exchanger according to the present invention.

Moreover, the heat exchanging structure 300 is provided with a lower distribution manifold 330 that is connected to a lower distribution channel 340, which in turn is connected to the lower end of each channel 320 in the fins 310 by means of a curved lower tubular connecting channel 322. The same arrangement is used at the lower end of the heat exchanging structure 100 in FIG. 1-2.

However, the distribution arrangement at the upper end of the heat exchanging structure 300 shown in FIGS. 3-4 does not have a distribution hub 150 and an axially centered center channel 160 as the above discussed heat exchanging structure 100 shown in FIGS. 1-2. On the contrary, the distribution arrangement of the heat exchanging structure 100 shown in the FIGS. 1-2 has been replaced in the heat exchanging structure 300 the shown in FIGS. 3-4 by an upper distribution arrangement comprising an upper distribution manifold 370 extending radially out of the heat exchanging structure 300, which manifold 300 is connected to an upper distribution channel 350 that in turn is connected to each channel 320 in the upper end of the fins 310 by means of curved upper tubular connecting channels 322 arranged at the upper end of the heat exchanging structure 300.

Exemplifying Cross-Sections

As indicated above, the fins 110, 310 or sheets or similar in an axial heat exchanger A1, A2 according to an embodiment of the present invention may be arranged according to different patterns having different cross-sections, wherein the fins 110, 310 or sheets or similar are extending in the axial extension of an outer enclosing channel 200, 400 so as to substantially coincide with the direction of flow of a medium that flows within the outer channel 200, 400.

A small number of schematic cross-sections are given below to illustrate the variety of possible cross-sections.

Figure 6A:
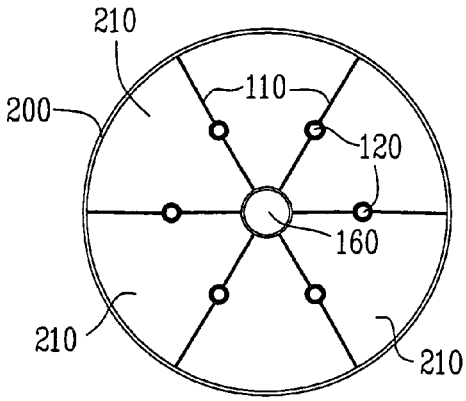
FIG. 6*a* shows a schematic cross-section of the heat exchanger A1 shown in FIGS. 1-2.

FIG. 6*a* shows a schematic cross-section of the previously discussed heat exchanger A1 in FIGS. 1-2, wherein the same numerals denote the same objects in all the FIGS. 1-2 and 6*a*.

Figure 6B:
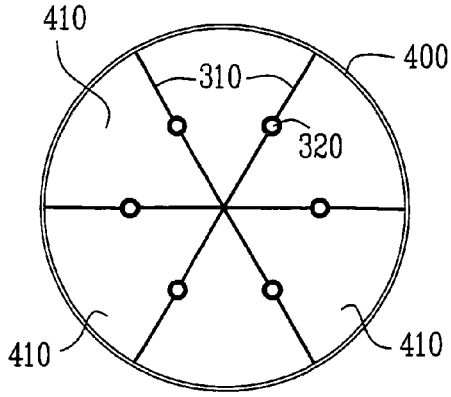
FIG. 6*b* shows a schematic cross-section of the heat exchanger A2 shown in FIGS. 3-4.

FIG. 6*b* shows a schematic cross-section of the previously discussed heat exchanger A2 in FIGS. 3-4, wherein the same numerals denote the same objects in all the FIGS. 3-4 and 6*b*.

Figure 6C:
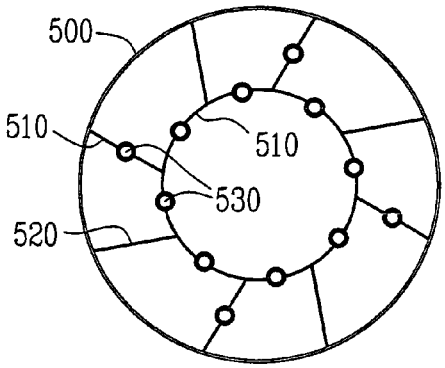
FIG. 6*c* shows a schematic cross-section of an axial heat exchanger according to a third embodiment of the present invention.

FIG. 6*c* shows a schematic cross-section of another possible pattern for arranging the fins or sheets within an outer channel of an axial heat exchanger according to an embodiment of the present invention. The axial heat exchanger comprises an outer tubular channel 500 that is similar to the outer channels 200 and 400. The outer channel 500 encloses an inner sheet 510 with the same tubular form as the outer channel 500 however with a smaller diameter. Oblique radial fins 520 are arranged between the inner tubular sheet 510 and the outer channel 500. The tubular sheet 510 and the fins 520 have the same or similar properties as the fins 110 and 310. The inner tubular sheet 510 is joined with tubular channels 530 at equidistant positions. Some of the fins 520 may also be joined with a tubular channel 530. The tubular channels 530 are similar to the inner channels 120, 320. The axial heat exchanger in FIG. 6*c* may for example use a distribution arrangement at the upper and lower end that is similar to the upper and lower distribution arrangement shown in FIG. 3-4, i.e. use connecting channels 321, 322 for connecting the inner channels 530 to distribution channels 340, 350 having a manifold 330, 370.

Figure 6D:
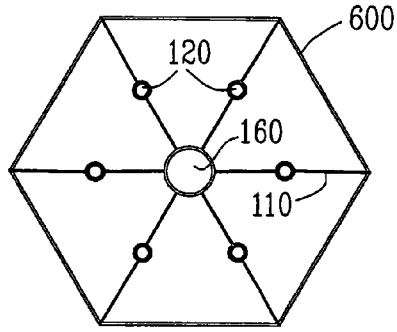
FIG. 6*d* shows a schematic cross-section of an axial heat exchanger according to a fourth embodiment of the present invention.

FIG. 6*d* shows a schematic cross-section of an axial heat exchanger that is essentially the same as the previously discussed axial heat exchanger A1 shown in FIGS. 1-2. However, the heat exchanger in FIG. 6*d* has been provided with six fins 110 instead of five fins 110 as in heat exchanger A1. Moreover, the outer channel 200 of the heat exchanger A1 has been replaced in FIG. 6*d* by an outer channel structure 600 made of an airtight clot material that is wrapped or otherwise arranged around the outside edges of the inner heat exchanging structure.

Figure 6E:
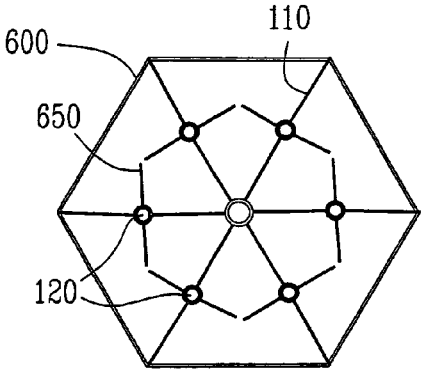
FIG. 6*e* shows a schematic cross-section of an axial heat exchanger according to a fifth embodiment of the present invention.

FIG. 6*e* shows the same axial heat exchanger as the one shown in FIG. 6*d*, with the exception that each inner tubular channel 120 of the axial heat exchanger in FIG. 6*e* has been provided with two extra fins 650 arranged 1800 apart and perpendicular with respect to the fin 110. Adjacent extra fins 650 provided on to adjacent channels 120 may be spaced apart by a small gap as, illustrated in FIG. 6*d*. However, they may alternatively be axially joined so as to create a good thermal connection between the extra fins 650.

Figure 6F:
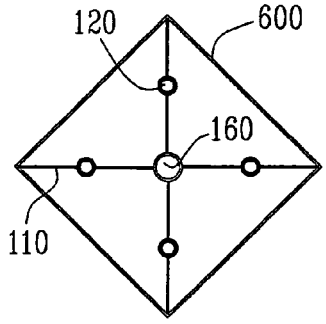
FIG. 6*f* shows a schematic cross-section of an axial heat exchanger according to a fifth embodiment of the present invention.

FIG. 6*f* shows the same axial heat exchanger as the one shown in FIG. 6*d*, with the exception that the axial heat exchanger in FIG. 6*f* has four fins 110 instead of six fins 110 as in the heat exchanger shown in FIG. 6*d*. It is especially advantageous to provide the rectangular axial heat exchanger in FIG. 6*f* with an outer rather thick protective cover consisting of a foamed plastic or a cellular plastic. This offers superior properties for transportation and storing. The protective cover may remain on the heat exchanger after installation of the exchanger.

A few schematic cross-sections have been briefly been discussed to illustrate the variety of possible embodiments of the present invention. However, other embodiments of the axial heat exchanger of the present invention may have fins or sheets that are arranged according to other suitable patterns that may or may not extend around the centre axis of an inner heat exchanging structure (e.g. the centre axis of the inner heat exchanging structures 100, 300), e.g. according a triangular, quadratic, rectangular, circular or semicircular pattern.

Operation and Use of Axial Heat Exchangers According to Embodiments of the Invention A first medium is supplied to the axial heat exchanger A1 trough the lower distribution manifold 130 and the lower distribution channel 140, from which the media flows into the channels 120 in the fins 110 and on to the upper distribution hub 150 and from there back through the center channel 160 that terminates in the center-channel manifold 170 from which the medium will be discharged from the heat exchanger A1. A second medium is supplied so as to flow through the heat exchanger A1 along the axial channel or channels 210 arranged in the space between the outer channel structure 200 and the inner heat exchanging structure 100. Heat will consequently be exchanged between the first and second media via the fins 110 arranged on the heat exchanging structure 100, provided that there is a temperature difference between the two media.

A first medium is similarly supplied to the axial heat exchanger A2 trough the lower distribution manifold 330 and the lower distribution channel 340, from which the media flows into the channels 320 in the fins 310 and on to the upper distribution manifold 350 that terminates in the distribution-channel manifold 370 from which the medium will be discharged from the heat exchanger A2. A second medium is supplied so as to flow through the heat exchanger A2 along the axial channel or channels 410 arranged in the space between the outer channel structure 400 and the inner heat exchanging structure 300. Heat will consequently be exchanged between the first and second media via the fins 310 arranged on the heat exchanging structure 300, provided that there is a temperature difference between the two media.

The first medium may flow in a direction that is opposite to the direction indicated above. The second media may flow by means of natural convection through the channel or channels 210, 410, especially in embodiment wherein the inner diameter of the outer channel structure 200, 400 is comparably large, e.g. 100-200 millimeters or more. In other words, some embodiments of the present invention may not need a fan or similar to propel the second media, whereas a fan or similar may be preferred or needed in other embodiments.

Axial heat exchangers according to the present invention can be used in a variety of different applications and in a variety of structures. In particular, a plurality of axial heat exchangers according to the invention may particularly be used connected in series or connected in parallel.

Figure 5A:
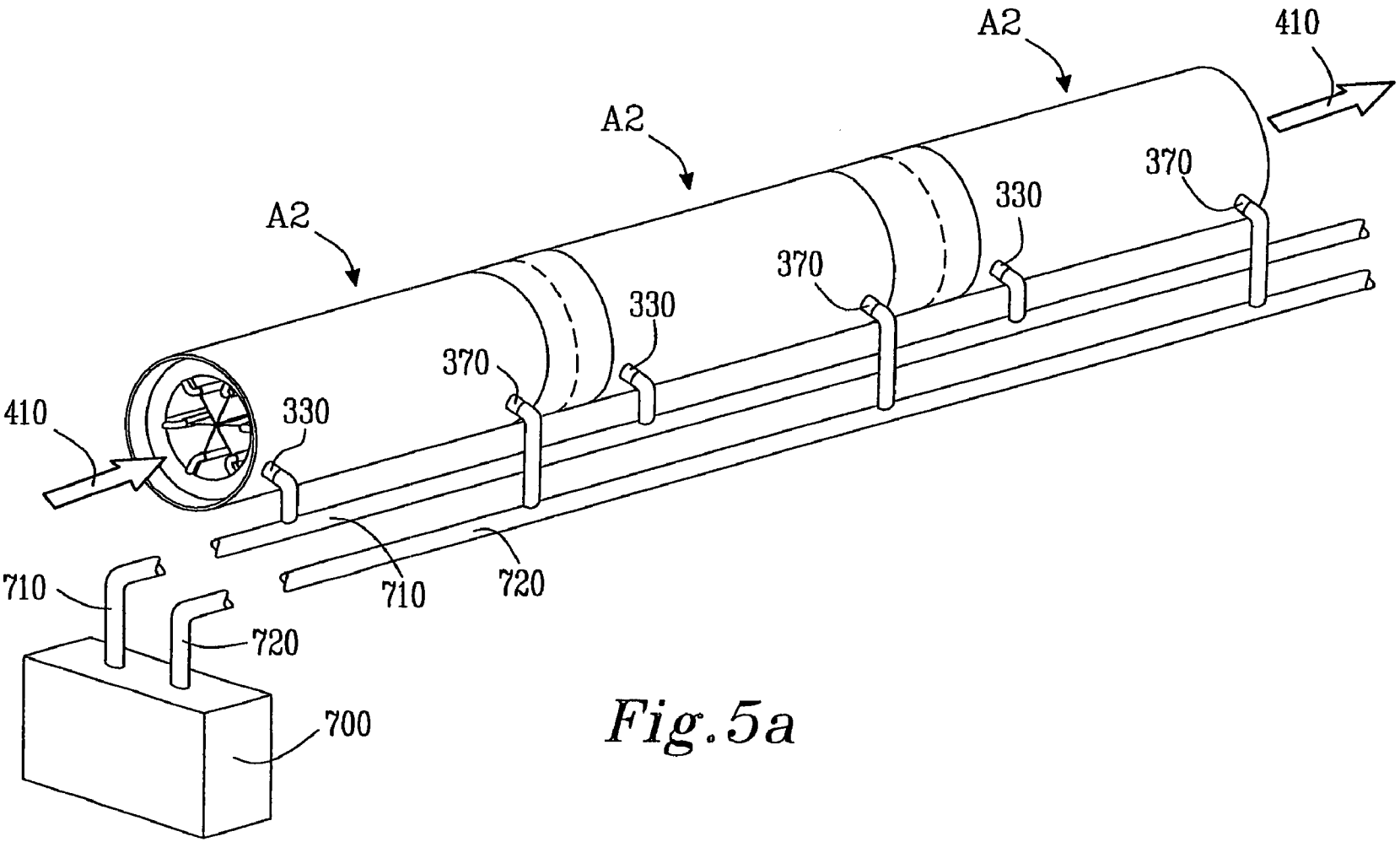
FIG. 5*a* shows a plurality of axial heat exchangers A2 according to the second embodiment of the invention shown in FIG. 3-4.

FIG. 5*a* shows a plurality of axial heat exchangers A2 according to the second embodiment of the invention as discussed above in connection with FIGS. 3-4. The heat exchangers A2 have been serially and axially coupled to enable a flow of a first medium (preferably air) from one heat exchanger A2 into the next and further on through all the axially coupled heat exchangers A2. The two arrows 410 in FIG. 5*a* indicate the flow. The arrows correspond to the medium channels 410 as discussed above in connection with FIG. 4. The heat exchangers A2 may e.g. be coupled to each other by means of a connecting part 420 adapted to fit closely around the outer channel 400 of a heat exchanger A2, so as to cover the joint between two axially arranged heat exchangers A2. The connecting part 420 may be a connector tube or a connector pipe having a slightly larger diameter than the outer diameter of the tubular outer channel structure 400. One heat exchanger A2 can then be axially inserted from each side into the connecting part 420 to form a self-supporting heat exchanging structure provided with substantially medium tight joints, e.g. air tight joints. The connecting part 420 may also be a cloth material or shrink band or similar that is wrapped or otherwise arranged around the joint between two axially coupled heat exchangers A2. A clot material may be particularly advantageous when the outer channel structure 400 is made of a clot material, in which case the connecting part can be made of the same material as the channel structure 400.

It should be added that axial heat exchangers A2 must not be axially coupled in a series to form an elongated structure that extends substantially centered along a centre axis as in FIG. 5*a*. On the contrary, a plurality of heat exchangers A2 may be axially coupled one after the other in a circle or semi-circular structure, in a rectangular structure or some other polygonal structure, or in any other structure that enables a flow of a first medium from one heat exchanger A2 into the next and further on through all the axially coupled heat exchangers A2. This may e.g. be accomplished by a suitable formed connecting part 420 that allows two heat exchangers A2 to be connected at an angle relative to each other. There may even be embodiments wherein the heat exchanger A2 it self is curved or twisted. By using a plurality of axial heat exchangers A2 that are coupled so as to extend along a curved or angular deflecting axis enables the heat exchangers A2 to be arranged as an integral part of an existing airshaft, upcast shaft, ventilating shaft; ventilating tube, ventilating pipe or similar. In such applications it may even be possible to use the wall of the existing airshaft etc. as a substitute for the outer channel 400 in the heat exchanger A2.

In other words, one heat exchanging structure 300 or several heat exchanging structures 300 coupled in a series may be are arranged in an existing airshaft etc. with or without the use of outer channels 400. In addition, each axially coupled heat exchanger A2 in FIG. 5*a* have been coupled to a supply channel arrangement extending along the axially coupled heat exchangers A2 for providing each exchanger with a flow of a second medium (preferably water). Accordingly, the lower distribution manifold 330 of each heat exchanger A2 has been coupled to a first supply channel 710, whereas the upper distribution manifold 370 of each heat exchanger A2 has been coupled to a second supply channel 720. One channel 710, 720 is arranged as a forward channel and the other as a backward channel. The first supply channel 710 and the second supply channel 720 are in turn connected to a medium tempering source 700, which is adapted for heating and/or cooling the second medium that flows through the supply channels 710, 720. Consequently, a heating of the second medium that flows through the channels 710, 720 and through each coupled heat exchanger A2 will be forwarded by the heat exchanging function of each exchanger A2 to cause a heating of the first medium (preferably air) that flows through the coupled heat exchangers A2. Similarly, a cooling of the second medium will be forwarded by the heat exchanging function of each exchanger A2 to cause a heating of the first medium (preferably air) that flows through the coupled heat exchangers A2. There may be a need for a circulation pump or similar for generating a flow of the second media through the supply channels 710, 720 and the coupled heat exchangers A2. The structure and the arrangement of the supply channels 710, 720 can be very similar to the supply pipes that are used in ordinary houses and buildings for providing heated water to radiators in an ordinary hot-water heating system.

Figure 5B:
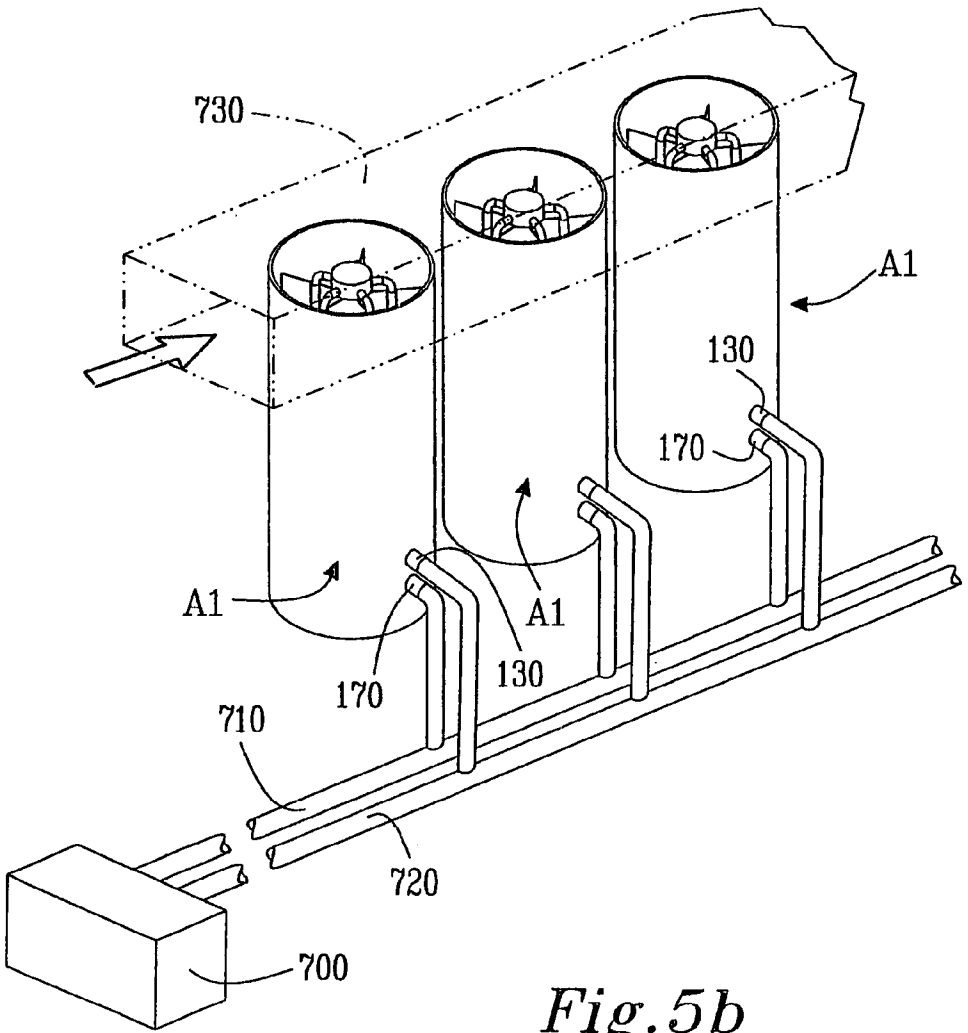
FIG. 5*b* shows a plurality of axial heat exchangers A1 according to the first embodiment of the invention shown in FIG. 1-2.

FIG. 5*b* shows a plurality of axial heat exchangers A1 according to the first embodiment of the invention as discussed above in connection with FIGS. 1-2. The heat exchangers A1 have been arranged in parallel to enable a substantially simultaneous flow of a first medium (preferably air) through each the heat exchanger A1 along the medium channel or channels 210 as discussed above in connection with FIG. 2. The heat exchangers A1 must not be arranged side by side along a straight line as in FIG. 5*b*. On the contrary, the heat exchangers A1 may be arranged side by side in a circle or in a semi-circle, or in a square or according to some other polygonal pattern.

Each parallel heat exchanger A1 in FIG. 5*b* have been coupled to a supply channel arrangement extending along the parallel heat exchangers A1 for providing each exchanger with a second medium (preferably water). Accordingly, the lower distribution manifold 130 of each heat exchanger A1 has been coupled to a first supply channel 710, whereas the center-channel manifold 170 of each heat exchanger A1 has been coupled to a second supply channel 720. The supply channel arrangement 710, 720 and the medium tempering source 700 shown in FIG. 5*b* can be the same as those previously described in connection with FIG. 5*a*.

Dashed lines in FIG. 5*b* illustrate a box-like distribution channel 730. Such a shared distribution channel 730 or similar may be arranged to cover one end of every parallel heat exchanger A1 for enabling a substantially parallel and possibly forced flow of a first medium through each parallel heat exchanger A1. The distribution channel 730 in FIG. 5*b* is arranged at the upper end of the parallel heat exchangers A1. It should be emphasized that the lower ends may be covered instead or as well. The upper ends in FIG. 5*b* may protrude a suitable distance into apertures (not shown) that have been arranged in the long-side of the box-like distribution channel 730 facing towards the parallel heat exchangers A1. The parallel heat exchangers A1 can be substantially sealed towards the outer side of the distribution channel 730 and the heat exchangers A1 are preferably fully open towards the inside of the distribution channel 730. The first medium can be provided to the distribution channel 730 from a supply channel (not shown) connected to the distribution channel 730. The arrow 740 in FIG. 5*b* indicates a possible direction of flow of the first medium into the distribution channel 730.

It should be added that the heat exchangers A2 in FIG. 5*a* may be replaced by substantially any heat exchangers according to the present invention and in particular by the heat exchanger A1. Similarly, the heat exchangers A1 in FIG. 5*b* may be replaced by substantially any heat exchangers according to the present invention and in particular by the heat exchanger A2. It should also be added that serially coupled heat exchangers as shown in FIG. 5*a* may be arranged side by side as indicated in FIG. 5*b*.

The large heat exchanging surfaces that can be obtained in an axial heat exchanger according to the present invention makes it possible to operate with low temperature differences between the first medium and the second medium. For example, embodiments of the present invention can operate with a comparable low difference in temperature between heating water and heated air flowing through and out from the exchanger or exchangers for creating a comfortable temperature in a defined space, e.g. in a room or a similar indoor space. A heat exchanger according to an embodiment of the present invention can certainly be adapted to use air having an input temperature as low as −18° C. to produce air having an output temperature as high as +18° C. by utilizing heated water or similar having an temperature as low as +35° C. In a heat exchanger according to the present invention can generally be adapted to enable heating of indoor spaces and similar by utilizing heated water having a temperature below +40° C. This should be compared to the water temperature supplied to radiators in ordinary hot-water heating systems, which in general is approximately +55° C. and which may be as high as +75° C. in a cold winter day when the outdoor temperatures is as low as e.g. −18° C.

REFERENCE SIGNS

| | |
|---|---|
| A1 | Axial Heat Exchanger |
| A2 | Axial Heat Exchanger |
| X1 | Center Axis |
| X2 | Center Axis |
| 100 | Heat Exchanging Structure |
| 110 | Fin, Sheet |
| 120 | Inner Channel |
| 121 | Upper Connecting channel |
| 122 | Lower Connecting channel |
| 130 | Lower Distribution Manifold |
| 140 | Lower Distribution Channel |
| 150 | Upper Distribution Hub |
| 160 | Center channel |
| 161 | Curved Section |
| 170 | Center-Channel Manifold |
| 200 | Outer Channel |
| 210 | Medium Channel |
| 300 | Heat Exchanging Structure |
| 310 | Fin, Sheet |
| 320 | Inner Channel |
| 321 | Upper Connecting channel |
| 322 | Lower Connecting channel |
| 330 | Lower Distribution Manifold |
| 340 | Lower Distribution Channel |
| 350 | Upper Distribution Channel |
| 370 | Upper Distribution Manifold |
| 400 | Outer Channel |
| 410 | Medium Channel |
| 420 | Connecting Part |
| 500 | Outer Channel |
| 510 | Inner tubular sheet |
| 520 | Oblique Fin |
| 530 | Inner Channel |
| 600 | Outer Channel |
| 650 | Extra Fin |
| 700 | Medium Tempering Source |
| 710 | First Supply Channel |
| 720 | Second Supply Channel |
| 730 | Parallel Distribution Channel |
| 740 | Medium Flow |

The invention claimed is:

1. An axial heat exchanger, comprising:

a longitudinal and substantially axially extended outer channel adapted to enclose a longitudinal and axial flow of a first gas medium through the outer channel, the outer channel including a first opening in a first end and a second opening in a second end longitudinally opposite the first end, the first opening and the second opening having a diameter substantially equivalent to a diameter of the outer channel, the first gas medium entering the outer channel through the first opening and exiting the outer channel through the second opening; and a plurality of substantially parallel inner channels adapted to enclose a flow of a second liquid medium, which inner channels are arranged inside the outer channel so as to extend substantially axially along the inside of the outer channel for enabling a transfer of heat between the first gas medium and the second liquid medium, wherein:

at least one inner channel is joined with at least one elongated sheet;

the sheet extends substantially axially along the inner channel so as to substantially coincide with the direction of flow of the first gas medium through the outer channel; and a center channel is axially arranged substantially along the center or center axis of the axial heat exchanger for distributing the second liquid medium to the inner channels.

2. An axial heat exchanger according to claim 1, wherein at least one end of an inner channel is coupled to a distribution channel by means of a connecting channel that extends in the same plane as the elongated sheet for reducing the possible impact on the substantially longitudinal and axial flow of the first gas medium.

3. An axial heat exchanger according to claim 1, wherein at least two of the sheets that extend in a first substantially axial direction inside the outer channel extends in a second radial direction substantially outwards from the center or center axis of the heat exchanger towards the outer channel.

4. An axial heat exchanger according to claim 1, wherein the sheet is a substantially elongated rectangular sheet structure wherein an inner channel is substantially longitudinally and axially joined along the middle or near the middle of the rectangular sheet structure.

5. An axial heat exchanger according to claim 1, wherein the outer channel structure is made of at least one of a thin sheet material, a shrink band, a shrink-wrapping, a shrink tubing, a foamed plastic, and a cellular plastic.

6. An axial heat exchanger according to claim 1, wherein the outer channel is a ventilating shaft.

7. A heat exchanging system comprising at least two axial heat exchangers according to claim 1, wherein:

the axial heat exchangers are serially coupled to enable a flow of a first gas medium through the outer channel of a first heat exchanger into the outer channel of the next heat exchanger and so on through each serially coupled heat exchanger; and the axial heat exchangers have a first distribution arrangement and a second distribution arrangement adapted to be coupled to a supply channel arrangement that extends substantially along the serially coupled heat exchangers for providing a low of a second liquid medium through the inner channels of each axial heat exchanger.

8. A heat exchanging system comprising at least two axial heat exchangers according to claim 1, wherein:

the axial heat exchangers are coupled in parallel to enable a substantially simultaneous and parallel flow of a first gas medium through the outer channel of the parallel heat exchangers; and each axial heat exchanger have a first distribution arrangement and a second distribution arrangement adapted to be coupled to a supply channel arrangement that extends substantially along the coupled heat exchangers for providing a flow of a second liquid medium through the inner channels of each axial heat exchanger.

9. A heat exchanging system according to claim 8, wherein at least one end of the parallel heat exchangers is coupled to a shared parallel distribution arrangement that is arranged for enabling a substantially simultaneous parallel and possibly forced tow of a first gas medium through the parallel heat exchangers.

* * * * *